United States Patent [19]

Selak

[11] Patent Number: 4,728,092

[45] Date of Patent: Mar. 1, 1988

[54] SUCTION CONTROL SYSTEM FOR SUCTION CUP SHEET FEEDING APPARATUS

[75] Inventor: Martin Selak, Des Plaines, Ill.

[73] Assignee: Astro Machine Corporation, Elk Grove Village, Ill.

[21] Appl. No.: 842,314

[22] Filed: Mar. 21, 1986

[51] Int. Cl.[4] ..... B65H 3/08

[52] U.S. Cl. ..... 271/100; 271/9; 271/104; 271/108; 271/171; 414/128

[58] Field of Search ..... 271/9, 171, 20, 95, 271/96, 99, 100, 101, 102, 104, 106, 107, 108, 165, 91, 92; 414/121, 128; 221/211; 294/64.1, 65; 269/21

[56] References Cited

U.S. PATENT DOCUMENTS

| | | | |
|---|---|---|---|
| 3,181,860 | 5/1965 | Liebenow et al. | 271/102 |
| 3,498,663 | 3/1970 | Cantrill | 294/65 |
| 3,617,048 | 11/1971 | Albert | 271/108 |
| 3,754,751 | 8/1973 | Capetti et al. | 271/108 X |
| 3,893,664 | 7/1975 | Thomsen | 271/100 |
| 3,991,997 | 11/1976 | Barber | 271/108 |
| 4,121,819 | 10/1978 | Di Francesco et al. | 271/108 X |
| 4,236,710 | 12/1980 | Nakamura et al. | 271/107 X |
| 4,437,657 | 3/1984 | Selak | 271/104 X |
| 4,592,542 | 6/1986 | Selak | 271/100 X |

*Primary Examiner*—Joseph J. Rolla
*Assistant Examiner*—Edward S. Ammeen
*Attorney, Agent, or Firm*—Russell E. Hattis

[57] ABSTRACT

Sheet feeding apparatus includes a relatively small number of horizontally adjustable suction cups distributed over the length of a feed opening. The suction cups are raisable to grasp the bottommost sheet in the stack at the most ideal position to assure removal of the sheet from the feed opening. Adjustable guide members align the corners of a stack of sheets above the feed opening. Each suction cup is fed from a separate pneumatic tube extending from a manually switchable control panel where a source of low suction pressure is selectively connectible to the suction cups in various connection combinations.

7 Claims, 22 Drawing Figures

FIG. 7A
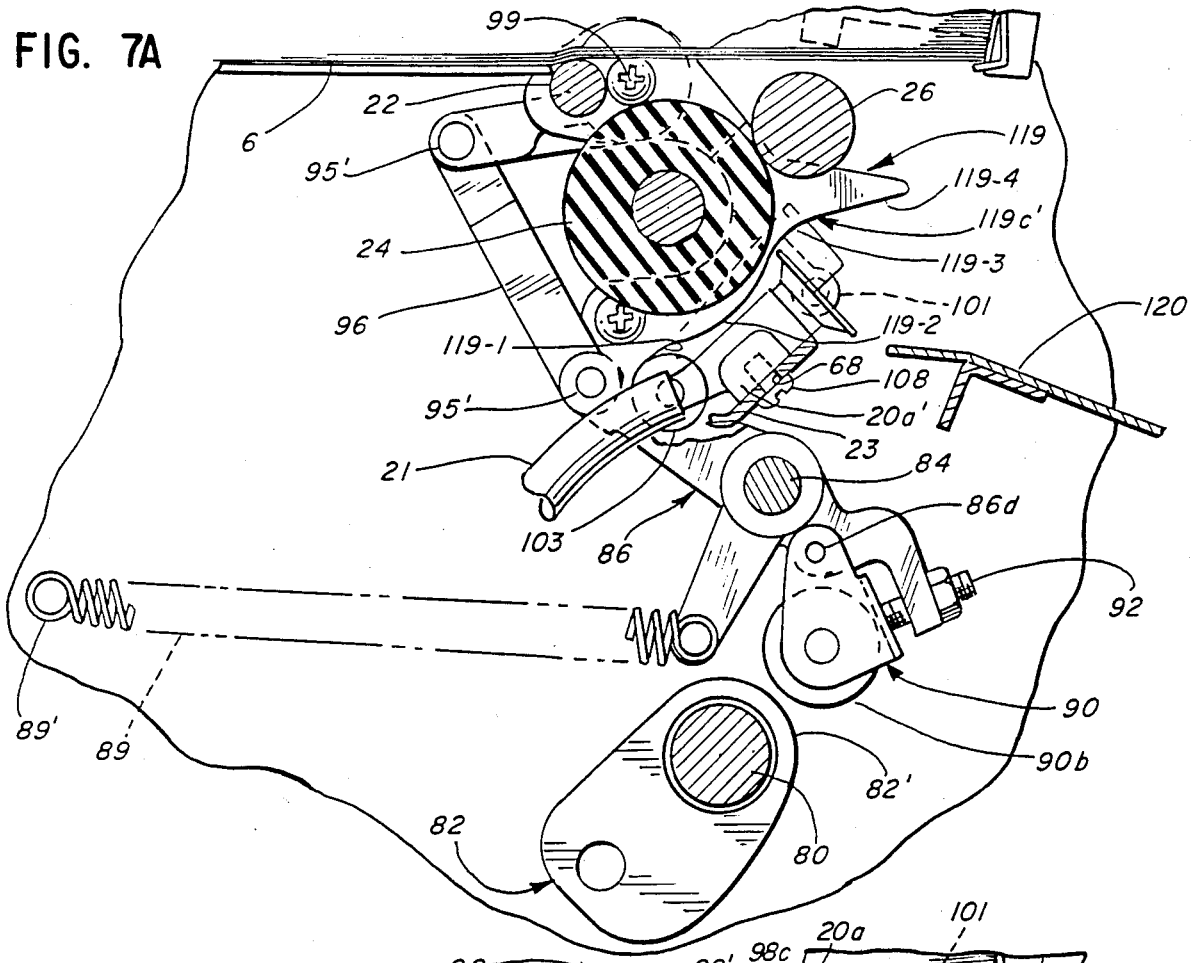
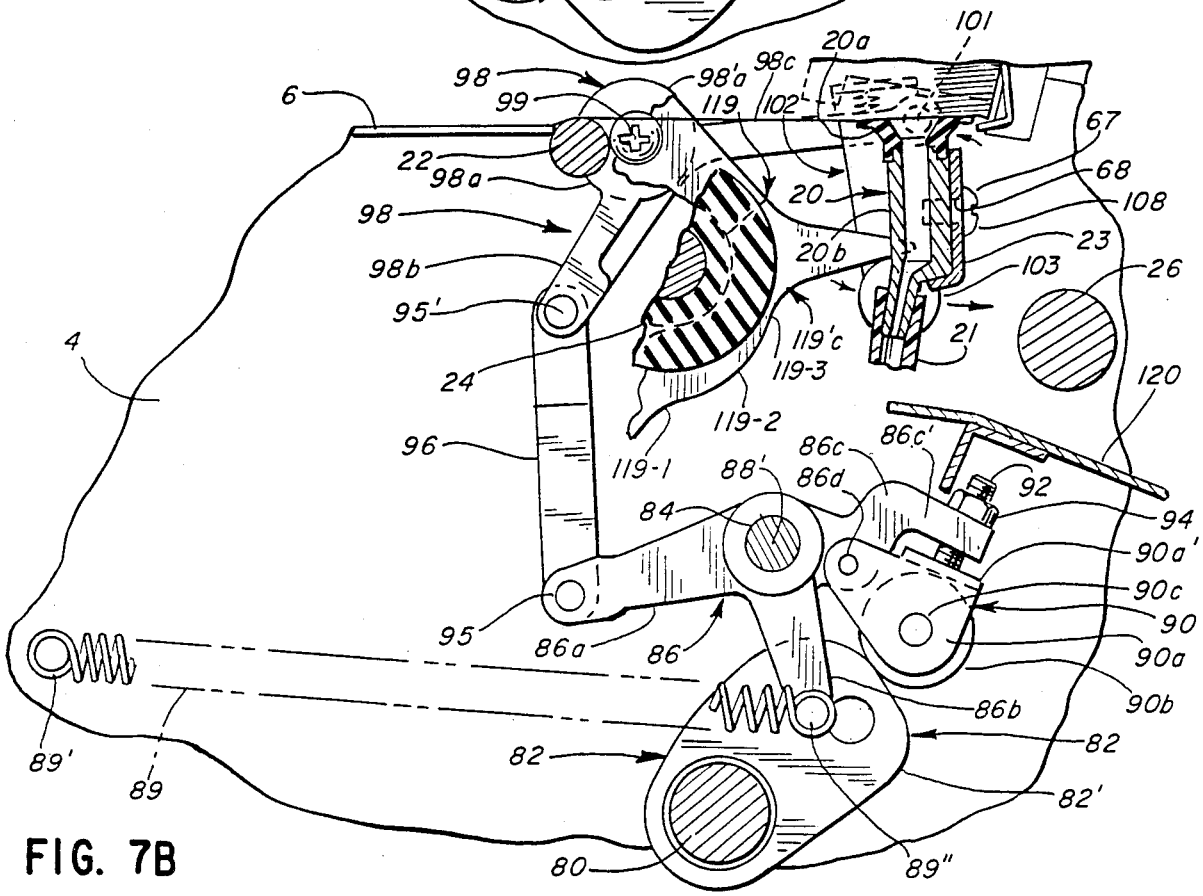
FIG. 7B

FIG. 8A
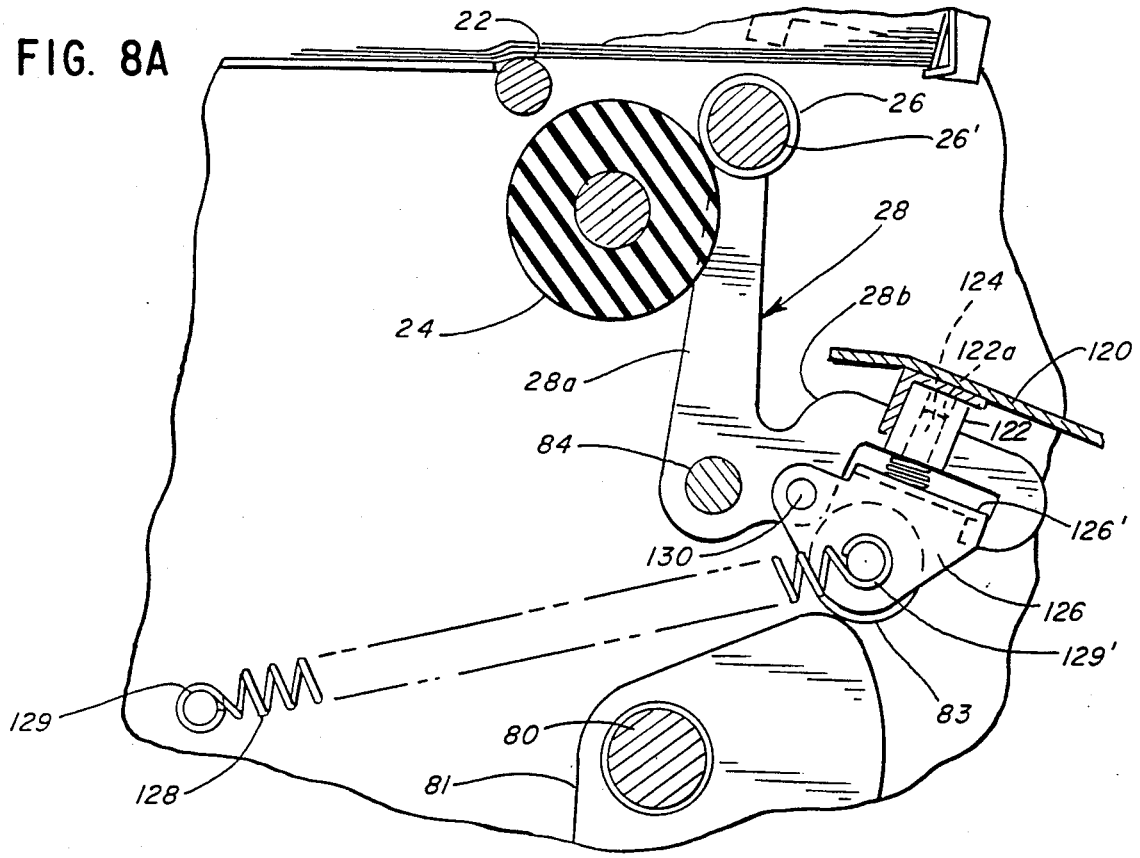
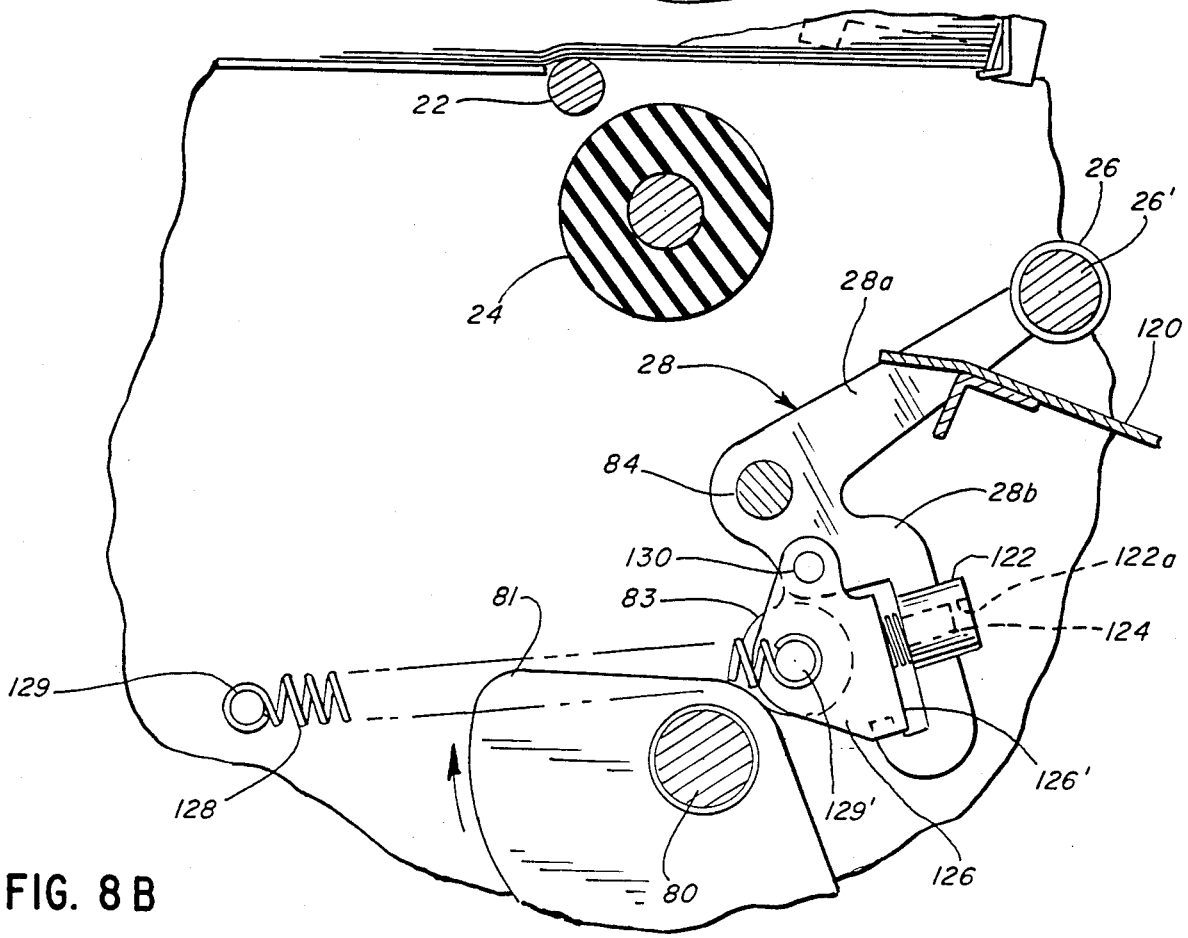
FIG. 8B

FIG. 13
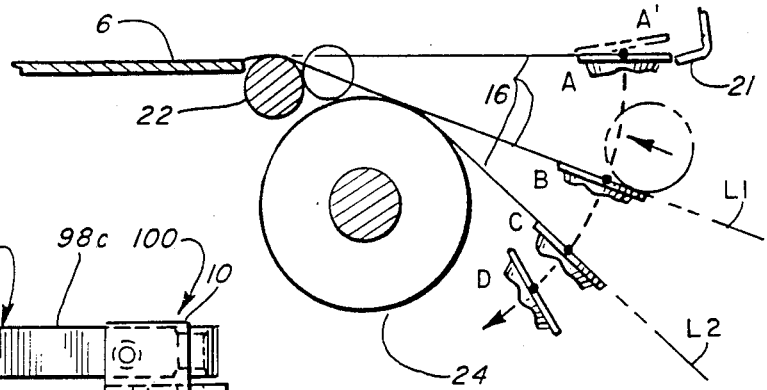
FIG. 9
FIG. 10
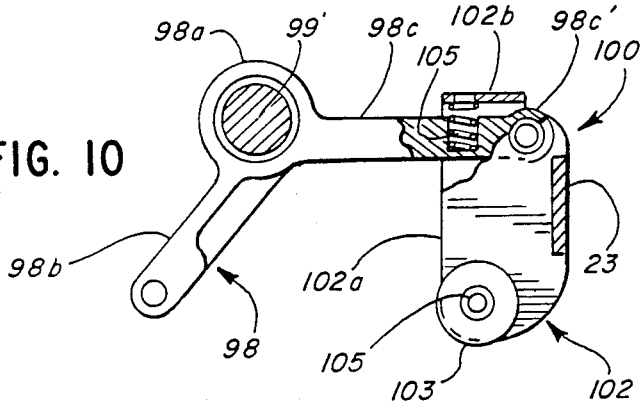
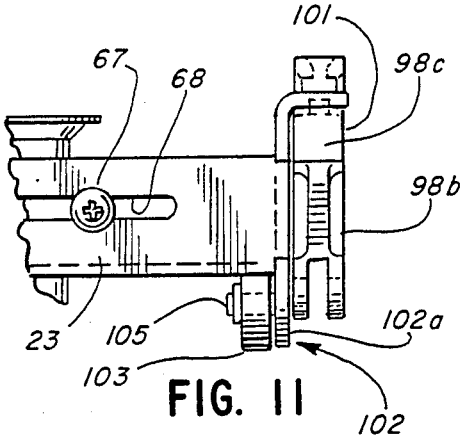
FIG. 11
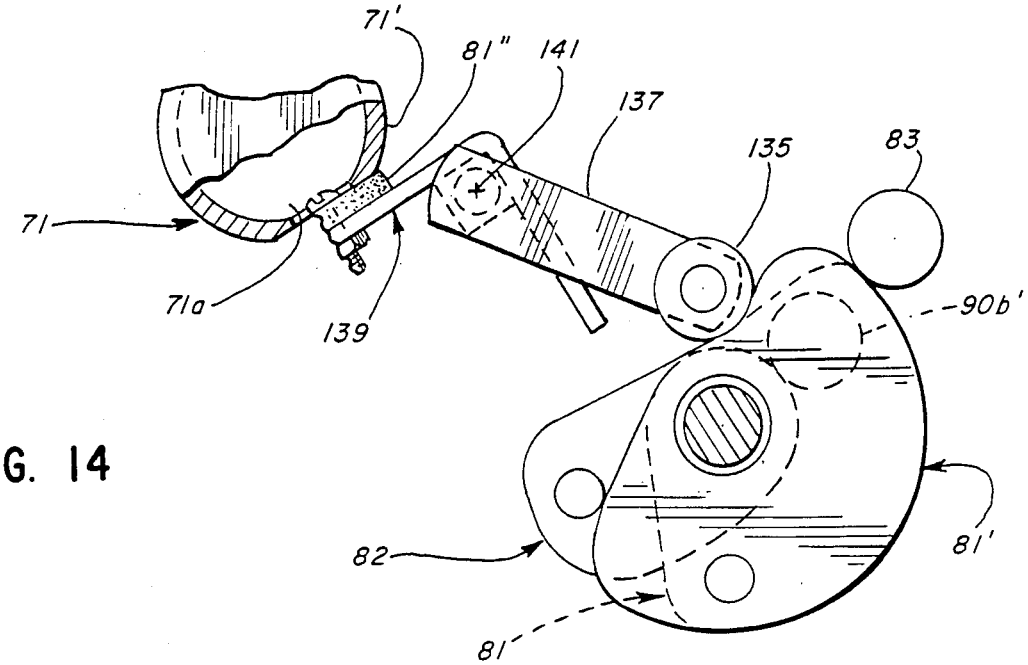
FIG. 14

FIG. 15
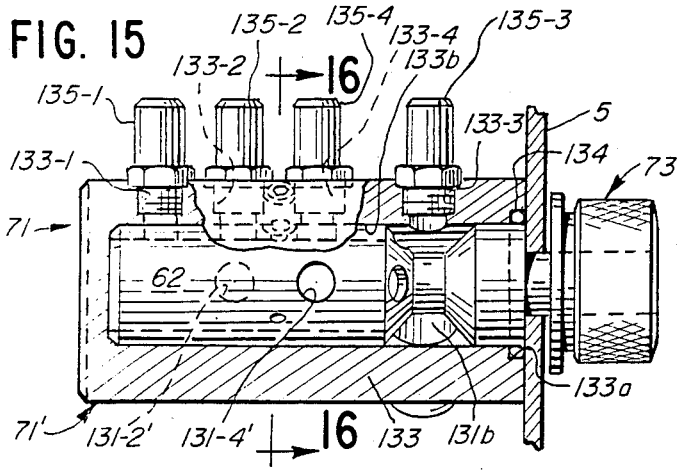
FIG. 16
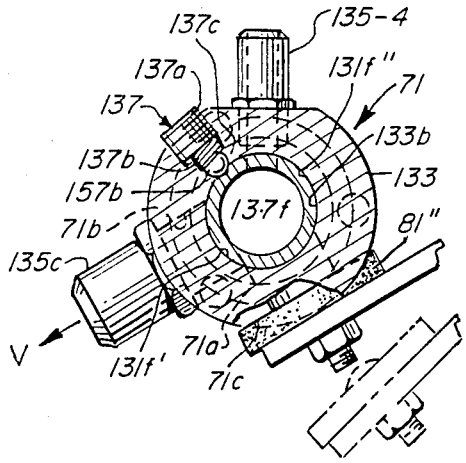
FIG. 17
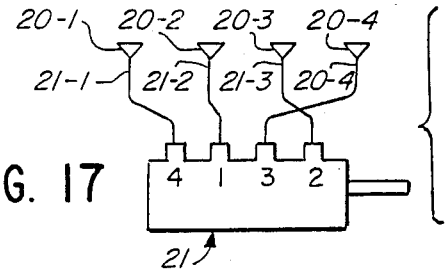
CENTER VALVE POSITION = 20-1, 2, 3, AND 4 OPEN
C.C.W. VALVE POSITION = 20-3 AND 20-4 OPEN
C.W. VALVE POSITION = 20-2 AND 20-3 OPEN
FIG. 18
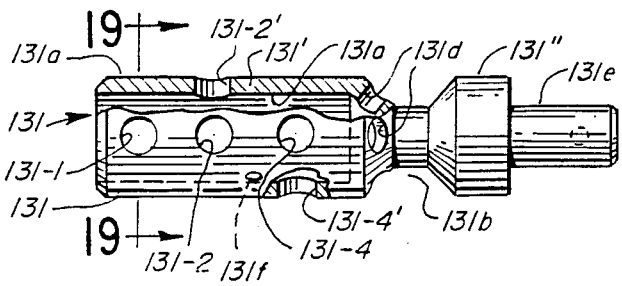
FIG. 19
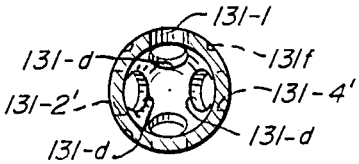
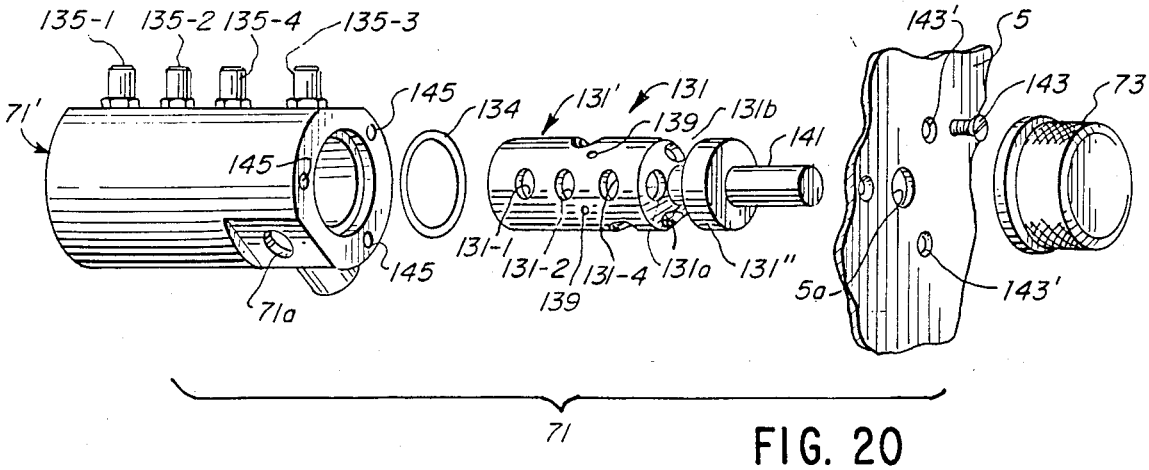
FIG. 20

SUCTION CONTROL SYSTEM FOR SUCTION CUP SHEET FEEDING APPARATUS

The present invention is an improvement over the sheet feeding apparatus disclosed in U.S. Pat. No. 4,437,657. The apparatus disclosed in this patent is designed to feed sheets of paper (or envelopes also to be referred to sometimes as sheets) to a printer unit. The corners of the sheets are supported separately by laterally adjustable guide members in a stack which can then be placed at a desired position above its feed opening. The feeding apparatus shown in this patent includes a fairly large number (e.g. 8) of fixed-in-position spaced suction cups supported on a common rigid pneumatic feed tube movable between an initially lowered position and a raised position below said feed opening where the suction planes of the suction cups are parallel to and engage the bottom exposed surface of the front edge portion of the bottommost sheet in the stack. The stack of sheets preferably rests on a slightly forwardly inclined support tray which terminates short of the lower front end of the stack to form said feed opening. The front end of the stack rests on longitudinally adjustable flexible support lips so that when the bottommost sheet is pulled from the stack by the lowering of the suction cups, the sheet deflects and wipes by the deflected lips, which spring back to retain the next sheet within the stacking frame.

Envelopes pose a special removal problem. The closure flaps of the stacked envelopes are on the bottom sides thereof to permit the top faces of the envelope to be printed upon. If only a few suction cups are provided, the operator can readily carelessly misalign or find it inconvenient to readjust the four separately adjustable stack-forming guide members to align the stack of envelopes, so that at least one suction cup is at the center line of the stack of envelopes. If the suction cups engage the portion of the envelope where the flap is located so as to overlap the same, the suction cups do not make a seal with the flap so that the suction cups slip from the envelope during the downward movement thereof from the stack. Where as disclosed in said patent, a large number of fixed-in-position suction cups are provided with adjustable means to selectively connect or shutoff each suction cup from connection to the source of suction, a desired pattern of operable suction cups can be formed for reliably grasping the envelope or other sheet of material for removal from the bottom of the stack of sheets involved. The use of a large number of fixed-in-position suction cups and the need to individually adjust the position of four guide members and the suction connections of a large number of suction cups unduly complicated equipment set-up for the obtainment of the most desired pattern of active operating suction cups.

SUMMARY OF THE INVENTION

In accordance with one of the features of the invention, instead of having a large number of fixed-in-position suction cup units mounted on a common support member which forms a pneumatic feed tube, a relatively few (like four) suction cups are adjustably mounted along the length of a common support member which preferably does not serve as a suction feed tube. In such cases, a separate feed tube is connected to each suction cup unit and these feed tubes extend to a cam controller valve which feeds suction to the suction cup units during the period when suction is required. A small number of suction cup units thus have a greater variety of positions along the feed opening than if a large number (like 8 suction cups) are fixed in position on the common support member.

While the broader aspects of the invention are not so limited, in its most preferred form, the valve is also a manually controlled valve having preferably a single manual control member which is movable into a plurality of different positions. In each different position of the manual control member, when suction is fed to the valve different ones of the feed tubes receive suction from the valve. For example, in one position of the control member all of the feed tubes receive suction. In a second position thereof only the feed tubes leading to a group of suction cup units on one side or the other of the feed opening receives suction from the valve, and in a third position thereof only the feed tubes leading to the innermost group of suction cup units receive suction from the valve.

The adjustability of the position of the suction cup units along the feed opening, and the easy selection of which particular suction cup units receive suction, taken together with the adjustability of the stack-forming guide member, cooperate to give a maximum flexibility and ease of setting of the sheet feeding equipment involved.

The above and other advantages and features of the invention will become apparent upon making reference to the specification and claims to follow and the drawings.

DESCRIPTION OF DRAWINGS

FIGS. 7A and 7B respectively show the position of the crank member linkages and cam controlling the movement and angularity of the suction cup support member for the lowest and the highest positions of the support member for a given peak elevation adjustment of the apparatus there shown;

FIGS. 8A and 8B show the corresponding extreme positions of the crank members and cams controlling the movement of the pressure rollers when the pressure rollers are respectively in their highest positions where they can press a partially removed sheet (not shown) against the drive roller and in their lowest positions;

FIG. 9 is a fragmentary top plan view at one end of the suction cup support member and shows the crank member and suction cup support member bracket carried thereby;

FIG. 10 is a side elevational view of the structure shown in FIG. 7, with part of the crank member broken away;

FIG. 11 is a broken away front elevational view of the structure shown in FIG. 7;

FIG. 13 shows the various positions of the planes of the suction cups and the sheet gripped thereby as the suction cups are lowered from their peak positions to bring the sheet against the drive roller;

FIG. 14 is a fragmentary vertical sectional view of the sheet feeding apparatus, as seen along section lines 14–14 in FIG. 5 and shows the suction control cam and movable element controlled thereby, as well as the other cams;

FIG. 15 is a longitudinal sectional view through the valve housing which controls which of the feed tubes extending to the suction cups to receive suction from a valve when the valve is not vented;

FIG. 16 is a transverse sectional view through the valve of FIG. 15, taken along section line 16—16;

FIG. 17 shows the connections between the different outlets of the valve housing to the various suction cups and includes a chart which indicates which suction cups are receiving suction to the different positions of the control knob of the valve;

FIG. 18 is a top plan view of the valve stem portion of the valve of FIG. 15, with the valve stem being partly broken away;

FIG. 19 is a transverse sectional view through the valve stem, taken along section line 19—19 in FIG. 18; and FIG. 20 is an exploded view of the different parts making up the valve shown in FIGS. 15 and 16.

GENERAL DESCRIPTION OF EXEMPLARY FORM OF THE INVENTION

Figures 1, 2:
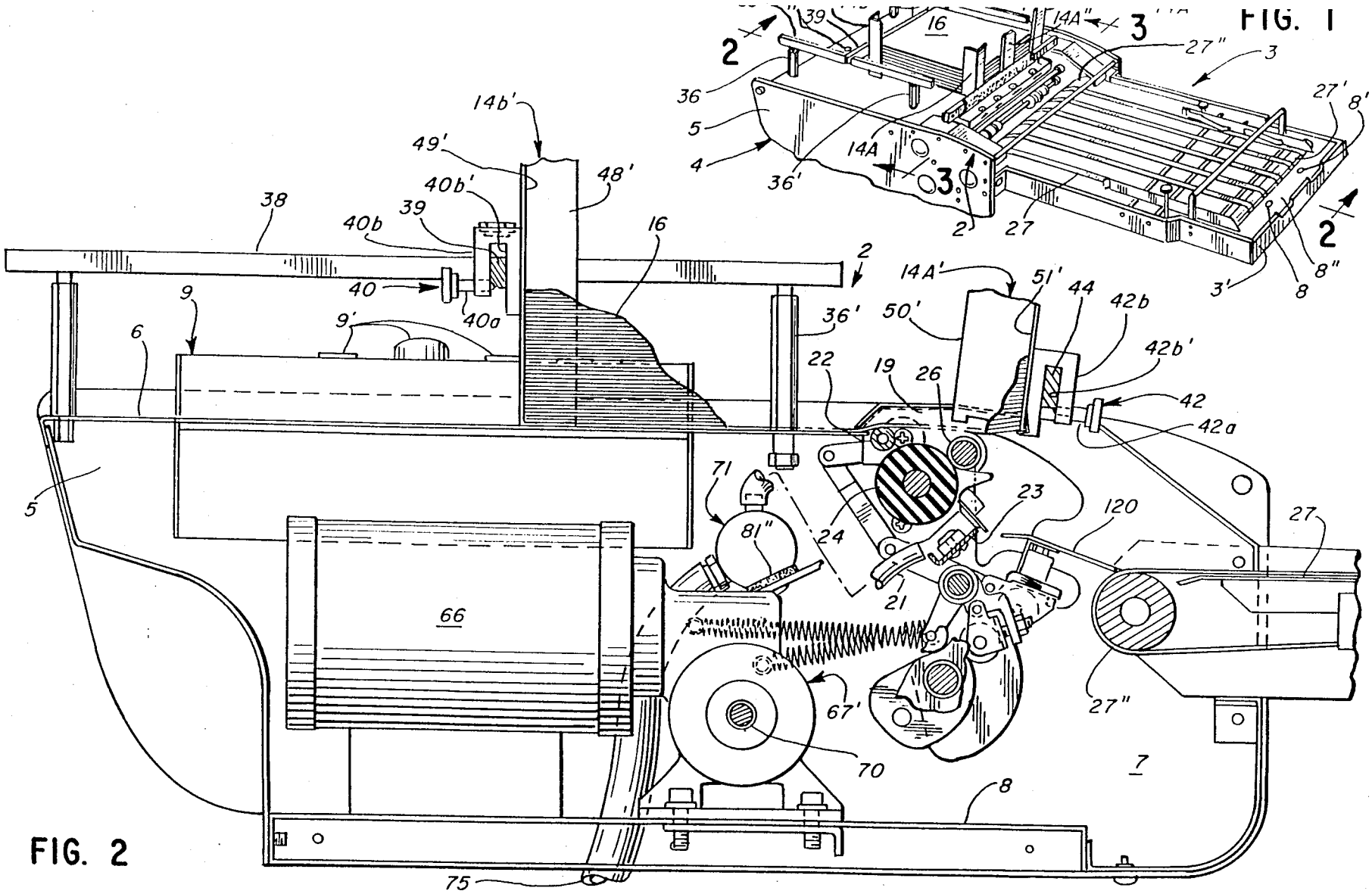
FIG. 1 is a perspective view of the sheet feeding apparatus of the invention.
FIG. 2 is a greatly enlarged fragmentary longitudinal sectional view through the sheet feeding apparatus of FIG. 1, taken along section line 2—2 shown in FIGS. 1 and 6 and with part of the stack of sheets broken away to expose more of the apparatus.

Referring now more particularly to FIGS. 1 and 2, the sheet feeding apparatus of the invention illustrated therein comprise a loading section 1, a sheet feeding section 2 and a conveyor section 3 contained within a housing 4.

The housing 4 includes longitudinal side walls 5—5, a bottom wall 8 (FIG. 2) and a slightly forwardly and downwardly inclining top wall 6 which forms a support tray for one or more stacks of sheet material to be fed one at a time from the bottom of each stack. (Reference to sheets or sheet material is intended to encompass envelopes, as well as individual single thickness sheets of material, having widely varying degrees of thickness and flexibility.) The housing 4 encloses a compartment 7 (FIG. 2) which contains the mechanical and electrical devices for operating the various parts of the apparatus to be described, a control box 9 (FIG. 6) having, in addition to electric control circuitry (not shown), various control pushbutton and knobs 9' for separately turning on and off an electric motor 66 and a pump (not shown).

The loading section 1 is adapted to support, for both lateral and longitudinal adjustment, upstanding forward guide members 14A, 14A' and 14A" and upstanding rear guide members 14B–14B' which confine a stack of sheets 16 of widely varying dimensions. (Only the bottom halves of the guide members are shown in FIG. 1.) The support tray 6 on the bottom of the loading station 1 terminates short of an adjustable support ledge formed by spring fingers 21 (FIGS. 2–4) confronting a feed opening 19 and carried by the front upstanding guide members. The widths of the ledge formed by the spring fingers 21 is variable.

Figure 5:
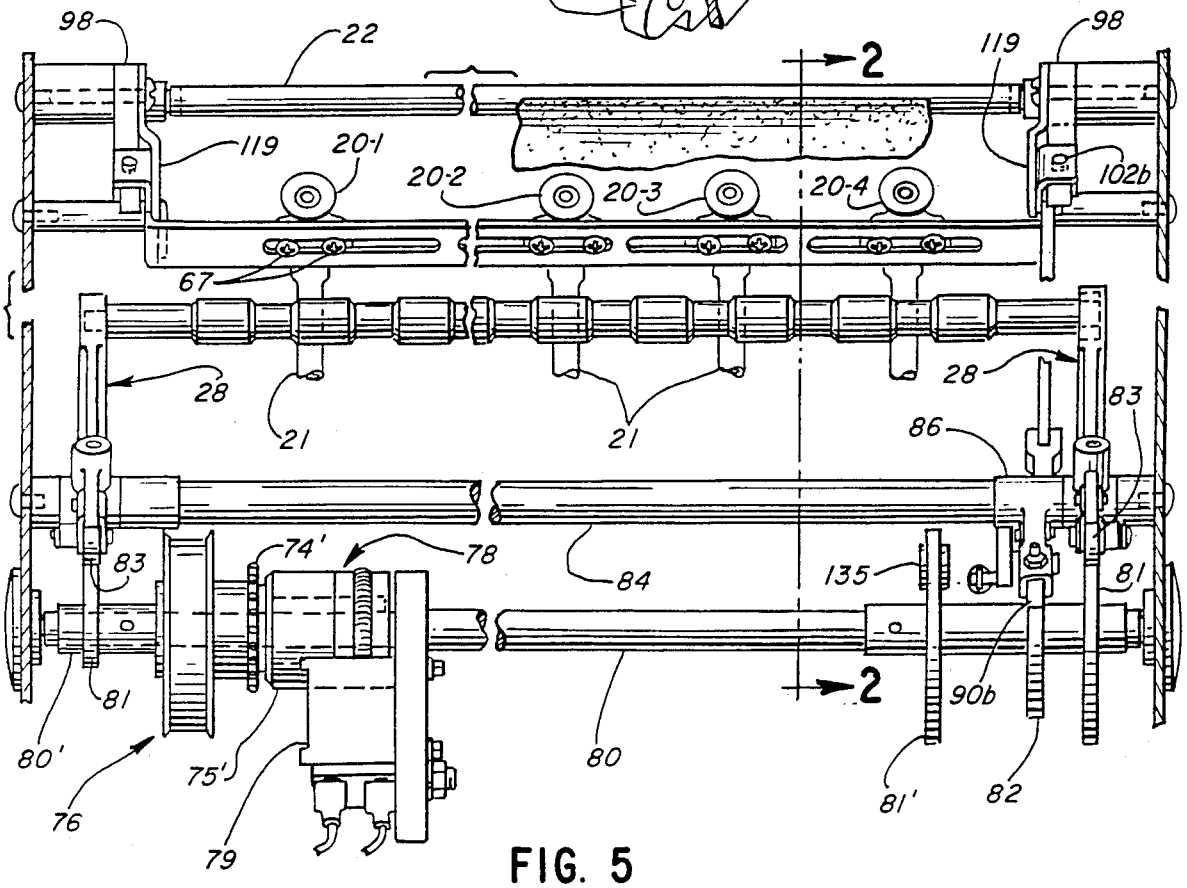
FIG. 5 is a broken away vertical transverse sectional view through the sheet feeding apparatus, taken along section line 5—5 in FIG. 6.

The bottommost sheet of each stack of sheets or envelopes involved is withdrawn downwardly from the stack of four suction cup units 20 (identified sometimes separately as 20-1, 20-2, 20-3 and 20-4 in FIG. 5, adjustably horizontally mounted on a support bar 23, in turn, secured to carrier means including various rockable links and crank arms to be described. The carrier means effect the raising of the suction cup units 20 from a lowered position to a raised position below a feed opening 19. Suction is applied to selected suction cup units 20 during a part of their path of movement so that they will attach themselves to the bottommost sheet in the stack and, upon subsequent downward movement thereof, will withdraw only this sheet from the stack. An idler roller 22 extends slightly above the level of the support tray 6 so that the bottommost sheet normally rests thereon. As the suction cups 20 are lowered, they pull the sheet involved down upon a continuously driven drive roller 24, whereupon pressure rollers 26 rotatably carried on a common shaft 26' supported on crank arms 28—28 are moved upward to press the sheet against the drive roller 24, which then feeds the sheet involved to the conveyor section 3 as suction is removed from the suction cups. The pulling of a semi-rigid cardboard sheet upon the drive roller can cause reaction forces on the sheet which have heretofore caused premature release of the suction cups 20 before the pressure rollers are in position to press the sheet against the drive roller. The sheet then springs back up out of the path of movement of the pressure rollers. The unique cam controlled positioning of the suction cups prevents this premature separation.

The conveyor section 3 is shown as including laterally spaced conveyor belts 27 (FIGS. 1 and 2) extending around drive and driven pulleys 27' and 27". The lateral position of the sheets delivered one at a time from each stack to a particular section of the conveyor belts 27 may be laterally constrained by suitable means (not shown in the drawings) as disclosed in U.S. Pat. No. 4,437,657.

Now that the basic parts of the sheet feeding apparatus have been introduced, the details thereof for the preferred form of the invention illustrated in the drawings will now be described.

Referring now more particularly to FIGS. 1 and 2, the loading section includes a framework upon which the upstanding guide members 14A, 14A', 14A"14B and 14B' are mounted. This framework includes a pair of upstanding rail support posts 36 extending upwardly from the rear sides of the support tray 6 and a pair of upstanding rail support posts 36' extending upwardly from the front sides of the support tray 6. A horizontal rail 38 extends between posts 36 and 36' on one side of the support tray 6 and a similar rail 38 extends between the posts 36 and 36' on the other side of the support tray 6. Slidably supported along and between the rails 38 is a rear cross rail 39, which has channels on the ends thereof which receive the rails 38, and clamping screws 41 (FIG. 2) which clamp the cross rail 39 in any selected longitudinal position along the associated rails 38. The cross rail 39 carries the rear upstanding guide members 14B and 14B'. Viewed from the conveyor side of the loading station, the upstanding guide member 14B is adapted to receive the rear left corner portion of the stack of sheets involved, and the upstanding guide member 14B' is adapted to receive the rear right corner of the stack of sheets involved. These guide members 14B and 14B' are angle members providing longitudinally extending surfaces like 48' which engage the longitudinal sides of the stack of sheets and transversely extending surfaces like 49' which engage the rear end of the stack of sheets. Each of the upstanding guide members 14B and 14B' has guide and clamping means 40 for securing the associated guide member in any adjusted position on the rail 39. Each guide and clamping means 40 includes a channel bracket **40*b* with a downward opening channel 40*b'* adapted to receive the rail 39 and a clamp screw 40*a* which threads through the bracket to engage the rail 39. The rail 39 is of a sufficient length to accommodate two pairs of the complementary upstanding guide members 14B–14B' if needed so that two laterally spaced stacks of sheets (or envelopes) 16 can be supported on the support tray 6**.

It can be seen that, viewing the loading section from the conveyor side thereof, the left upstanding guide member 14A is adapted to receive the left front corner of the stack of sheets and the right upstanding guide member 14A' is adapted to receive the right front corner of the stack of sheets. Accordingly, these guide members made of angle members have confronting longitudinal surfaces like 50' which engage the longtiduinal sides of the stack of sheets and lateral surfaces like 51' which engage the front ends of a stack of sheets.

The intermediate upstanding guide member 14A' is shown as comprising a vertical strip of metal which provides a surface which engages the front end of the stack of sheets. This upstanding member is not normally needed where relatively narrow sheets of material are to be stacked.

The front upstanding guide members 14A, 14A', and 14A'' are mounted for lateral adjustment on a cross rail 44 positioned in confronting relation to the feed opening 19 at the front of the support tray 6. The upstanding guide members 14A, 14A' and 14A'' are slidably upported upon rail 44 by guide and clamping means 42 similar to the means 40 and each comprising a channel bracket **42*b* having a downwardly opening channel 42*b'* slidably receiving the cross rail 44, and a clamping screw 42*a* for locking the channel bracket in any desired position along the rail 44**.

Thus, the rear upstanding guide members 14B–14 B' are adjustable both laterally and longitudinally of the loading section, the rail 44 carrying the upstanding front guide members 14A, 14A', and 14A'' may be (but are not as shown) adjustable longitudinally over a limited distance.

Figure 4:
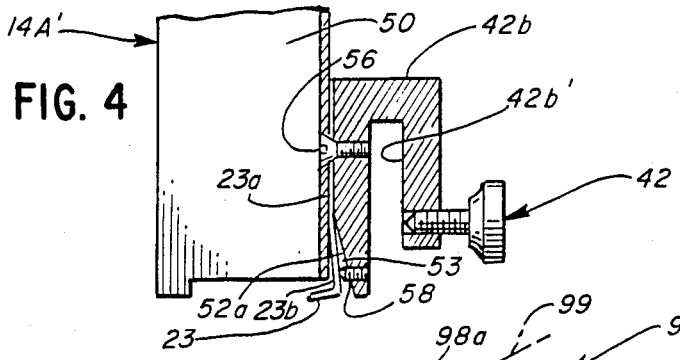
FIG. 4 is a fragmentary vertical sectional view through the upstanding guide member of FIG. 3.
Figure 3:
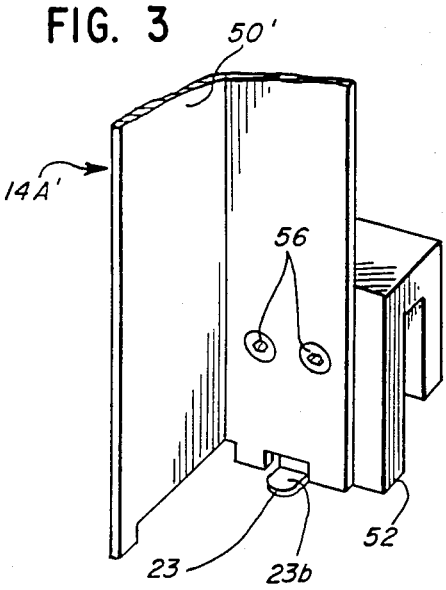
FIG. 3 is a fragmentary perspective view of one of the front support ledge-carrying upstanding guide members at the loading section of the sheet feeding apparatus.

Each of the front upstanding guide members 14A, 14A' and 14A'' has a construction best illustrated in FIGS. 3 and 4, wherein is shown the bottom construction of the righthand upstanding member 14A', it being understood that the bottom portion of the other front upstanding guide members 14A and 14A'' have the same construction as there shown. Thus, each of these members has a longitudinally adjustable spring finger support lip 23 at the bottom thereof which supports the bottom of the front ends of the sheets of material involved in a manner to assure that only one sheet at a time is fed from the stack involved by the suction cups 20. Each spring lip 23 extends laterally from a vertical support arm **23*a*. The vertical arm 28*a* is sandwiched between the rear leg 52 of the channel bracket 42*b* and the adjacent wall of the associated upstanding guide member. A locking screw 56 threading into an opening in the bracket leg 52 securely clamps the upper portion of the vertical arm 23*a* in place. The bottom end of the bracket leg 52 has a tapered portion 52*a* which forms a clearance space 53 in which the lower portion of the vertical arm 23*b* may be moved in a longitudinal direction by the adjustment of a screw 58 threading into an opening in the bottom portion of the bracket leg 52. Thus, by rotating the adjusting screw 58, the degree to which the support ledge-forming spring lip 23** projects rearwardly beyond the adjacent wall of the upstanding guide member which engages the front end of the stack of sheets is varied to accommodate sheets of different stiffness and flexibility.

Figure 12:
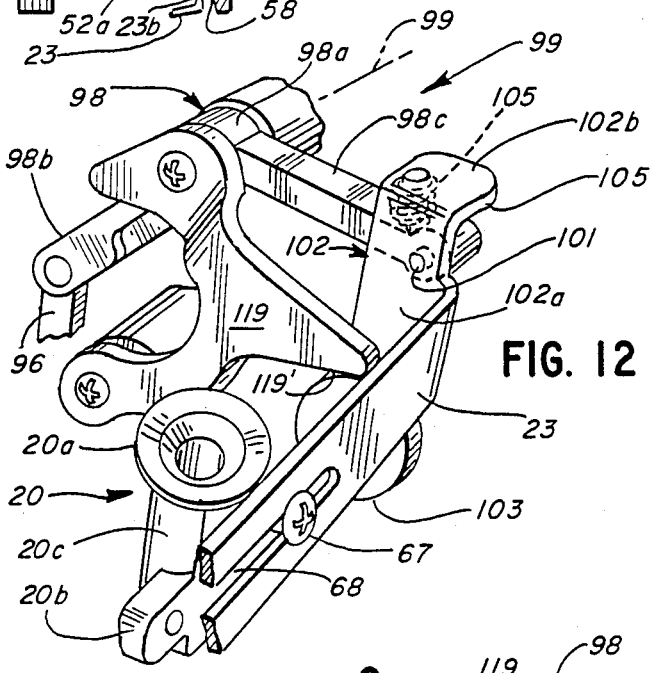
FIG. 12 (shown next to FIGS. 3 and 4) is a perspective view of the structure shown in FIGS. 7 through 9 with a stationary cam added thereto.

The four suction cup bodies 20 have mounting flanges **20*b*—20*b* (FIG. 12) into which are threaded adjusting screws 67 slidable in slots 68 in the support bar 23 so that each of the suction cup units can be adjusted over a limited horizontal extent to provide the best combination of suction cup positions for a given sheet stacking arrangement. Individual suction tubes 21' extending from the suction cup unit bodies 20*b* may connect to a housing 71' (FIGS. 2 and 14) of a control valve 71 which includes a control knob 73 (FIG. 6) which selectively controls the feeding of suction to all or selected ones or pairs of the suction cup units 20-1, 20-2, 20-3, or 20-4. A suction line 75 extends from the control valve 71** to the inlet side of a suitable pump (not shown).

Figure 6:
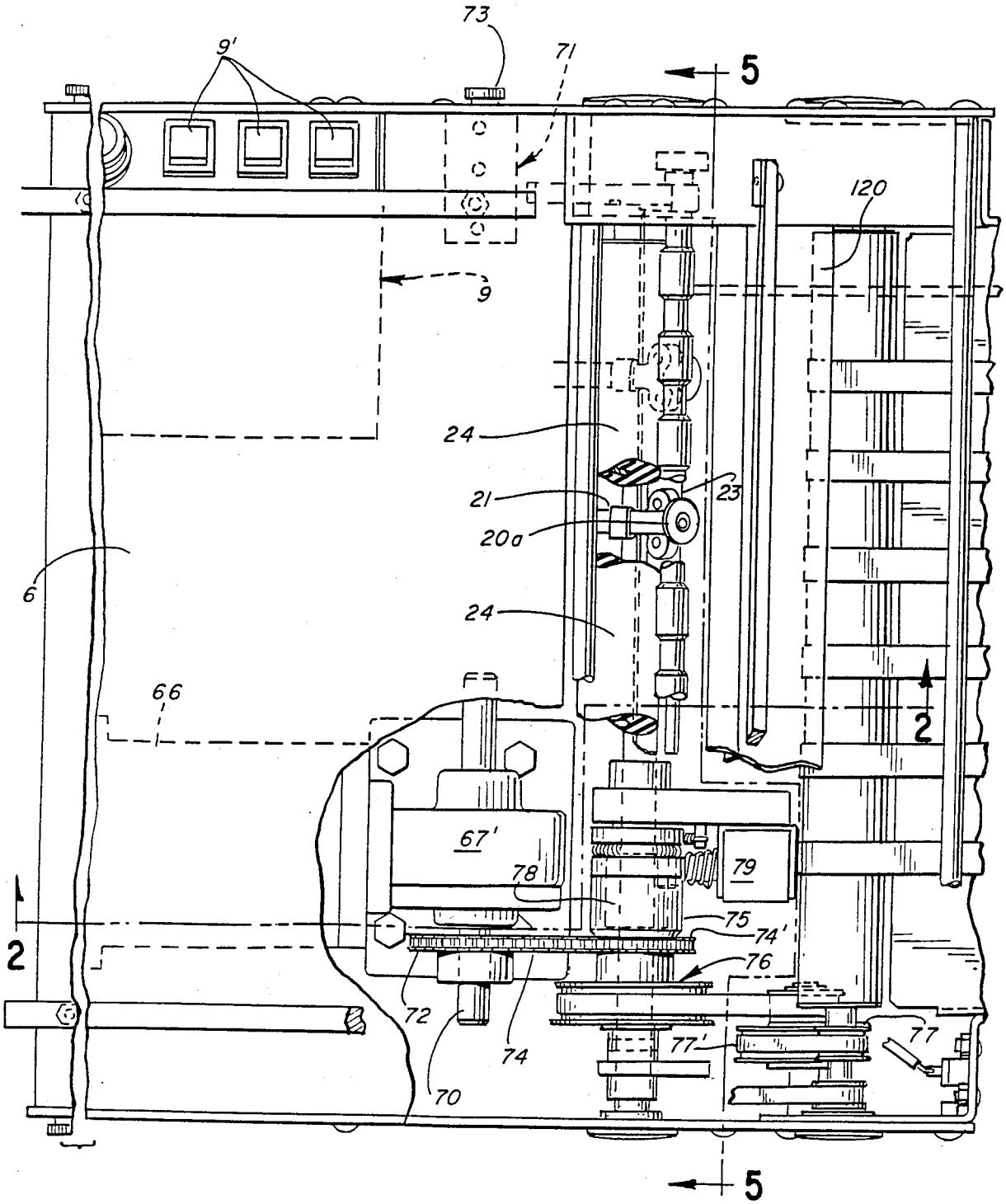
FIG. 6 is a plan view, partly broken away view of the sheet feeding portion of the apparatus of FIGS. 1–5.

Drive power for the feeding and conveyor sections of the sheet handling feeding apparatus of the exemplary form of the invention being described is best shown in FIGS. 1, 5 and 6 to which reference is now made. An electric motor 66 drives a speed reducer 67' which imparts continuous rotation to a drive shaft 70 having a sprocket 72 at one end thereof which drives a chain 74 extending over another sprocket 74'. A pulley and belt transmission generally indicated by reference numeral 76 continuously operates various drive shafts (some not shown), such as the shaft of the aforementioned conveyor belt pulley 27'' which carries a pulley 77 and belt 77' which drives a shaft (not shown) which carries the drive roller 24.

The chain sprocket 74' is secured to the power input shaft 75' of any suitable single cycle operating clutch mechanism 78 (FIG. 5) controlled by a solenoid 79 which preferably receives a pulse from electric eye switches located below apertures 8 (FIG. 1) in a ledge 8'' at the front of the conveyor section 3. When a sheet is delivered to the end of the conveyor section 3, it rests against a stop wall 3' adjacent the ledge and reflects light upon the light sensors of the electric eye switches. When a suction cup pick-up device associated with a sheet handling device like a printer raises the sheet from the conveyor section, the change in the reflected light then operates the switches. This switch operation operates the solenoid 79 to permit the clutch 78 to rotate a cam control shaft 80 one revolution each time the solenoid is momentarily energized as described. (The solenoid 79 may have a spring urged locking pawl, not shown, which is withdrawn from a slot in a drive shaft of the clutch mechanism to permit a 360° rotation when the pawl again enters the slot to stop shaft rotation.) The electric eye switches referred to thus effect automatic internal synchronism of the sheet feeding apparatus independently of the speed of operation of the motor 66. This unique sheet feed synchronizing system just described is the subject of another patent application.

As shown in FIG. 5, the cam control shaft 80 carries at the right hand end thereof as viewed in this figure a cam 81 which controls the up and down movement of the pressure roller-carrying shaft 26', a cam 82 which controls the up and down movement of the suction cup support bar 23, and a suction control cam 81'. To reduce the overall width of the apparatus shown, the shaft 80 has a left hand portion 80' which extends within the clutch input shaft 75 so as to be exposed to the left of a belt pulley carried on the shaft 75. (It is apparent that the shaft 75 of the clutch mechanism 78 could be located totally to the left of the entire cam shaft 80 but this would require widening of the housing 4.)

Cam follower rollers 83—83 carried on pivotably mounted crank members 28—28 ride on the surface of the cams 81—81 to control the up and down movement of the pressure roller shaft 26' in a manner to be described. A follower roller 90*b* carried on a crank member 86 controls the up and down movement of the suction cup support bar 23 in a manner now to be described. A roller 135 rides on the suction control cam 81' to move a vacuum breaking vent cover 81" (FIG. 16) toward and away from the suction control valve 71.

FIG. 7A shows the position of control cam 82 when the suction cup support bar 23 is in its lowermost position. The suction cup units 20 on the mounting bar 23 are movable between the lowermost position shown in FIG. 7A to an uppermost position shown in FIG. 7B. Secured to the ends of the support bar 23 are end brackets 102—102 best seen in FIGS. 9–12. Each bracket includes a vertical portion 102*a* which terminates in an outwardly extending flange 102*b*. The vertical portion 102*a* of each bracket is pivotally mounted at 101 to a forwardly projecting arm 98*c* of a crank member 98 pivoted on a pivot axis 99.

A spring 105 mounted in an upwardly opening recess in the arm 98*c* applies an upward force against the associated flange 102*b* to urge each bracket 102 in a clockwise direction as viewed in the drawings. A cam follower roller 103 rotatably mounted at the bottom end of each vertical portion 102*a* of each bracket 102 is urged by the associated spring 105 against downwardly facing surface 119' of a stationary cam 119.

The position of the cam follower rollers 103—103 carried by the brackets 102—102 determines the angle of inclination of the suction cup mounting bar 23 and the gripping planes of the flexible suction cups 20*a* of the suction cup units 20. As previously explained, the suction cups 20*a* initially make contact with the bottommost sheet in the stack of sheets involved at positions where their gripping planes are parallel to the sheets. The suction cups are then raised slightly from this position and then pivoted in a counterclockwise direction as viewed in the drawings, to facilitate separation of the bottommost sheet from the sheet above the same. This counterclockwise movement is achieved by the movement of the follower rollers 103 to the right over the outermost portions 119-4 of the cam surfaces 119'.

Each crank member 98 has a central hub 98*a* pivoted on a pivot axis 99. The right crank member 98 has an arm 98*b* pivotally secured to one end of a link 96 at 95'. The other end of the link 96 is pivoted at 95 to a rearwardly extending arm 86*a* of one of the crank members 86 mounted on a shaft 84 for pivoting movement about a pivot axis 88'. Each crank member 86 has an arm 86*b* urged rearwardly by a coil spring 89 connected between a stationary pin 89' and a pin 89" on the arm 86*b*. The coil spring 89 urges the follower roller 90*b* carried by only the right crank member 98 shown in FIG. 5 against the associated cam 82. The follower roller 90*b* forms part of a follower roller assembly 90. As previously indicated, the cam 82 mounted upon the right end of the shaft 80 makes a single revolution each time the control solenoid 79 receives a single control pulse resulting from the raising of a sheet from the end of the conveyor section 3, and in so doing, causes the crank members 98—98 to rock back and forth once to cause the roller 103 to transverse cam surface portions 119-1, 119-2, 119-3 and 119-4. In so doing, the gripping planes of the suction cups 20*a* vary as shown in FIG. 13.

The follower roller assembly 90 includes a support frame 90*a* upon which the follower roller 90*b* is rotatably mounted. The support frame 90*a* is pivotably mounted about a pivot pin 86*d* projecting from an arm 86*c* of the associated crank member 86. The crank arm 86*c* has an outermost portion 86*c*' through which is threaded an adjusting screw 92. The bottom end of this screw 92 bears against the upper surface 90*a*' of the roller support frame 90*a*. As the screw 92 is rotated in one or the other direction the crank member 86 is pivoted in one direction on the other to vary the spacing between the follower roller assembly 90 and the crank arm 86*c* and the angular position of the crank arm 86 for a given position of the follower roller 90*b* on the cam 82. A lock nut 94 is threaded around the screw 92 to lock the screw in its adjusted position. It can thus be seen that as the screw 92 is adjusted, the peak elevations reached by the crank arm 86*c* and the crank arms 98*c*—98*c* constituting the carrier for the suction cup units are adjusted.

As the cam 82 is rotated in a clockwise direction from the position shown in FIG. 7A where the suction cups 20*a* are in their lowermost positions, the crank members 98—98 carrying the same are pivoted by the linkage described in a counterclockwise direction to gradually raise the crank member arms 98*c*—98*c* to move the follower rollers 103 along the cam surfaces 119'. In FIG. 7A, it is noted that the roller 90*b* is not touching the cam 82. This is so because the surface of the cam 82 has not yet reached a point where it will engage the roller 90*b*. The linkage mechanism thereshown need only be operated by the cam 82 over a portion of the rotation of the cam 82 where it is desired to begin raising the suction cups 20 into the various positions described.

FIG. 13 illustrates four different angular positions A, B, C, and D which the gripping planes of the suction cups 20*a* have as they are progressively lowered (or raised) to the point where they first make parallel contact with the bottommost sheet 16 diagrammatically illustrated. The suction cups are raised a short distance above this position to its peak position A' where they have been pivoted counterclockwise away from the lips 21. As the suction cups are raised, they progressively have the positions D, C, B, A, and A' (before they have gripped and pulled a sheet of material from the bottom of the stack). When the suction cups are lowered from the peak position A', suction cups have the progressive positions A, B, C, and D. In position B, the suctions cups have pulled the front end of the sheet 16 down to where it strikes the upper surface of the drive roller 24. As the suction cups are lowered from this position to position C the sheet 16 will progressively contact additional points on the surface of the drive roller. It is noted that as the sheet is thus progressively wrapped around the upper surface of the drive roller, it extends along progressively varying tangent lines like L1 and L2. One of the aspects of the invention is that in order to prevent premature separation of the suction cups from a rigid sheet of material, the gripping planes of the suction cups should be substantially parallel to the tangent lines like L1 and L2 as illustrated until suction is interrupted at position C. The suction cups are then lowered further to position D.

When the suction cups 20 are in position C where suction is removed, a rigid or semi-rigid sheet will then spring upwardly. If the suction cups had released from a rigid sheet 16 before position C which sometimes occurred in the prior art which did not use the suction cup plane control as described, the rigid sheet would spring upwardly and return to the plane of the bottom of the stack of sheets prior to the time the rising pressure rollers 26 reached a point where the sheet would be caught by the rollers moving upwardly and toward the drive roller 24. However, as shown in FIG. 13 when the suction cups leave contact with the sheet in position C, the pressure rollers 26 are already in a position where the sheet 16 will be caught by the rollers 26 which will thus ultimately press the sheet down upon the feed roller 24 as the pressure rollers assume the position shown in FIG. 7A. In this position, the drive roller 24 effects complete removal of the sheet 16 from the stack of sheets and directs the sheet first upon the downwardly and forwardly inclining directing plate 120 which then directs it upon the inlet end of the conveyor section 3.

Refer now to FIGS. 8A and 8B which show the cam and crank member apparatus involved in the raising and lowering of the pressure rollers 26. As previously explained, the cam shaft 80 carries on the opposite ends thereof cams 81—81, one of which is shown in FIGS. 8A and 8B. (It should thus be understood that the apparatus shown in FIGS. 8A and 8B are duplicated at the opposite end of the shaft 80.) Follower roller 83 is shown engaging the surface of the cam 81. The roller 83 is rotatably mounted upon a roller carrier frame 126 which is pivoted at 130 to one of the arms **28*b* of crank member 28. The crank member 28 is pivotably mounted on the same shaft 84 which carries the crank members 86—86 which control the up and down movement of the suction cups. The crank arms 28—28 will rotate on the shaft 84 in opposite directions to the direction of rotation of the crank members 86—86. The crank arm 28*b* has a boss 122 with a threaded bore 122*a* into which is threaded an adjusting screw 124 which adjusts the spacing between the crank arm 28*b* and a shoulder 126' of the roller carrier frame 126. A spring 128 extending between a stationary pin 129 and a pin 129' on the roller carrier frame 126 urges the roller 83 upon the surface of the cam 81. Adjustment of the screw 124 adjusts the angular position of the crank member 28 for a given positon of the roller 83 on the surface of the cam 82**.

The crank member 28 has an arm **28*a* which carries the pressure roller carrying shaft 26'. As the cam 82 is rotated in a clockwise direction from the position shown in FIG. 8A which shows the uppermost position of the pressure roller 26 resting against the drive roller 24, the roller carrying shaft 26' is progressively dropped to the lowermost position shown in FIG. 8B as the suction cups 20*a*** are moved to their uppermost position shown in FIG. 7B.

FIG. 14 illustrates the manner in which the suction of the suction cups is preferably controlled. The valve 71 has the vent aperture **71*a* which, when open, terminates suction to the feed tubes 21. The vent cover 81'' is carried on the end of a handle member 139 which is welded or otherwise secured to a roller-carrying arm 137. Assembly of the roller carrying arm 137 and the angle member 135 are pivoted about a horizontal axis 141. The arm 137 carries a cam follower roller 139 which rides on the surface of the cam 81'. If the cam rotates, the force of the cam surface on the roller 135 will cause the arm 137 and the angle member 139 to pivot about the pivot axis 141 to raise and lower the vent cover 81'' to open and close the venting aperture 71*a*. The vent cover 81'' will cover the venting aperture 71*a* as the suction cups are moved into position where they first engage the bottom sheet of the stack of sheets as the suction cups are lowered to the position C shown in FIG. 13. Thereafter the venting aperture 71*a* is opened as the vent cover 81'' is moved away from the aperture 71*a***.

Reference should now be made to FIGS. 15 through 20 which shows the details of the control valve 71. The valve comprises the valve housing 71', a valve stem 131 and control rods 73. The housing 71' has a cylindrical body portion 133 closed at the left hand end as viewed in FIG. 15 and open at the right hand end to expose an O-ring-receiving seat **133*a*. The body portion 133 has a main cylindrical cavity 133*b* intersected by four axially aligned vertical threaded apertures 133-1, 133-2, 133-4 and 133-3, positioned in the order named. Threaded into the apertures 133-1 to 133-4 are feed tube-receiving fittings 135-1, 135-2, 135-4 and 135-3. The feed tubes 21-1, 21-2, 21-4 and 21-3 respectively extend between the feed tube fittings 135-1, 135-2, 135-4 and 135-3 to the suction cup unit races to which suction cups 20-1, 20-2, 20-3, and 20-4** are connected.

The aforementioned vent opening apertures **71*a* extends between the cavity 133*b* and the exterior of the housing 71' at the same axial position ut spaced circumferentially thereof as the aperture 133-3. A suction inlet aperture 71*b* also extends between the cavity 133 are exterior of the housing 71 at this same axial variation. An inlet feed tube fitting 135*c* is threaded within the aperture 71*b* and the suction tube 75 (FIG. 2) extends therefrom to feed suction to the fitting 135*c*. The vent aperture 71*a* is also located at the same point along the cavity 133*b* as the suction inlet aperture 71*b* and the suction cup feed tube fitting 135-3. The vent aperture 71*a* opens onto a flattened portion 71*c* of the valve housing 71' to form a seat for the vent cover 81'' which in one position thereof closes off the venting aperture 71*a*. The suction delivered by the suction inlet tube 75 is then effective to cause suction to be established within the cavity 133*b***.

A detent assembly 137 is provided to enable the valve stem 131 to have any one of three stable positions within the valve housing 71'. The detent assembly includes a spring-containing housing **137*a* which has a spring 137*c* grasping a detent ball 137*b* which projects into the housing cavity 133*b*, as best shown in FIG. 16**.

The valve stem 131 has a hollow cylindrical body portion 131' separated from a solid cylindrical portion 131'' by an annular recess **131*b*. The hollow housing portion 131' has a cylindrical cavity 131*a* therein which communicates with the annular recess 131*b* through spaced apertures 131*d*. The valve stem 131 which is rotatable within the cylindrical cavity 133*b* of the valve housing 71' has three aligned apertures 131-1, 131-2, and 131-4, which can be aligned with the valve housing apertures 133-1, 133-2 and 133-3 in the so-called centered position of the valve stem 131. In this centered position, all of the feed tube fittings 135-1, 135-2, 135-4 and 135-3 receive suction as long as the venting aperture 71***a* is covered by the vent cover 81". The centered position of the valve stem is maintained by the reception of the detent ball 137*b* within a center detent 137*f* formed on the exterior of the hollow portion 131' of the valve stem 131. The hollow body portion 131' has two additional detent recesses 137*f* and 137*f*" as best shown in FIGS. 16. The detent recesses 137*f* and 131*f*" are located 90° on opposite sides of this center detent recess 137*f*. It is thus apparent that the valve stem has three stable positions, two of them being located respectively 90° counterclockwise and 90° clockwise of the centered position of the valve stem described.

As best shown in FIG. 15, the valve stem has an aperture 131-4' communicating between the valve stem cavity 131*a* and the exterior of the valve stem. The aperture 131-4' is located 90° clockwise from the aperture 131-4 when the valve stem is viewed from the lefthand end of FIG. 18. It should thus be apparent that in the so-called counterclockwise position of the valve stem 131, suction is delivered through the valve stem aperture 131-4' to the feed tube fitting 135-4. In this position also, when suction inlet tube 75 delivers suction to the portion of the valve stem having the annular recess 131*b*, suction is also fed to the feed tube fitting 135-3.

The valve stem also has an aperture 131-2' located 90° counterclockwise from the valve stem aperture 131-2 so that when the valve stem is rotated 90° clockwise from its centered position, the aperture 131-2' will be aligned with and will feed suction to the feed tube fitting 135-2.

It should now thus be apparent that in the centered position of the valve stem 131, all of the suction cups receive suction as long as the venting aperture 71*a* is covered; and in the so-called counterclockwise position of the valve stem the feed tube fittings 135-4 and 135-3 respectively feed suction through feed tubes 21-4 and 21-3 to suction cups 20-4 and 20-3 which are located on the right half of the suction cup support member 23. When the valve stem 131 is in its clockwise position, the feed tube fittings 135-2 and 135-3 receive suction so that the two centermost suction cups 20-2 and 20-3 receive suction.

The valve 71 is mounted on the right side wall 5 of the housing 4 as shown in FIG. 6 and the exploded view of FIG. 20. Thus, the valve stem 131 has a cylindrical projecting portion 131*e* adapted to be passed through an aperture 5*a* in the side wall 5. Control knob 73 is anchored by a screw (not shown) to the cylindrical projecting portion 141. Before the knob 73 is attached to the projecting portion 141, screws 143 are passed through apertures 143' in the wall 5 and threaded into threaded apertures 145 in the end face of the valve housing 71'. The sealing O-ring 134 is compressed against the seat 133*a* as the screws 143 are tightened to seal the valve housing 71' against the inner face of the wall 5. The valve stem 131 is rotatable within the housing cavity 133*b* and can be detented at any one of the three positions described by rotation of the control knob 73.

It should be appreciated that with the available selection of the different positions of the valve stem 131 and the suction cup units on the suction cup support member 23, the operator can quickly obtain the most ideal arrangement of active suction cups for the effective removal of envelopes or when sheet material from the bottom of the stack or stacks thereof. As previously indicated, the adjustable guide members, like 14A, 14A' and 14A", 14B and 14B', permit various stacking arrangements which can include one or two adjacent stacks of envelopes and other sheet material of different sizes.

It is thus apparent that the present invention provide a unique and advantageous manner for controlling both the back elevation of the suction cups and the gripping planes thereof to provide for a most reliable removal of sheets of all degrees of flexibility from a stack of sheets.

It is intended that broad claims not specifying details of a particular embodiment disclosed herein as the best mode contemplated for carrying out the invention should not be limited to such details. Further, whole specific claimed details of the invention generally constitute important specific aspects of the invention, in appropriate instances even the specific claims involved should be construed in light of the doctrine of equivalents.

I claim:

1. In a sheet feeding apparatus comprising: adjustable stacking means for supporting an end portion of a stack of sheets in confronting relation to a feed opening having a length encompressing many widths of a narrowest sheet to be accommodated thereby, so that one or more stacks of such material can be supported along said feed opening and the longitudinal center line of any stack thereof can be positioned along different selected points along the length of said feed opening, sheet withdrawal means for engagig the bottom surface of the bottom sheet in any stack of sheets located at almost any position along the length of the feed opening, said sheet withdrawal means comprising suction cup units each having a body and a flexible suction cup portion projecting from said body, said suction cup units being aligned parallel to the length of said feed opening and distributed over said length of said feed opening, a source of suction, suction control means for selectively connecting or disconnecting said source of suction to and from, respectively any selected suction cup body, and carrier means for supporting and moving said suction cup units toward and away from said feed opening to simultaneously bring said flexible suction cup portions of the units into and out of engagement with the bottom sheet in said stack and then withdraw the sheet therefrom, said carrier means for the suction cup units including a common support member for all the suction cup units, said common support member being raised and lowered to simultaneously bring the flexible suction cup portions of said units into and out of engagement with the bottom sheet in said stack, the improvement in said suction control means comprising: separate conduit means connecting said source of suction of each of said suction cup unit bodies, and a single manual control member movable into a number of distinct positions for coupling said source of suction to different combinations of said suction cup unit bodies independently of the position of said adjustable stacking means, so that differently sized sheets or stacks of sheets variously positioned with respect to the centerline of said feed opening can be accommodated.

2. The sheet feeding apparatus of claim 1 wherein in one of said positions of said single manual control member said source of suction is fed to a first group of adjacent suction cup units bodies, in a second position thereof said source of suction is fed only to a different group of adjacent suction cup unit bodies, and in a third position thereof said source of suction is fed to all suction cup unit bodies.

3. The sheet feeding apparatus of claim 1 wherein said single manual control in one operative position thereof connects said source of suction of all suction cup unit bodies simultaneously and in at least two other positions thereof respectively connects said source of suction only to an innermost of the suction cup unit bodies and only to an outermost group of suction cup unit bodies.

4. The sheet feeding apparatus of claim 1 wherein there are provided means for supporting said suction cup unit bodies for individual movement parallel to the length of the feed opening, and means for locking the suction cup unit bodies in their adjusted positions on said common support member.

5. The sheet feeding apparatus of claim 1 wherein said adjustable stacking means are guide members individually adjustable parallel to the length of said feed opening so as to receive and align the corners of sheets of different size at any desired center point along said feed opening.

6. The sheet feeding apparatus of claim 1 wherein there are only about four of such suction cup units distributed along said common support member.

7. The sheet feeding appartus of claim 1, wherein there is provided means for supporting for individual movement and means for locking the suction cup units. said suppot means enable the centermost of said suction cups to be adjustable along the center sections of said common support member and the outermost of said suction cup units to be adjustable along the outermost portions of said common support member, so that the suction cups are movable and lockable in positions which encompass positions on said common support member where the suction cups are raisable into position at selected points encompassing most of the length of said feed opening.

* * * * *